US005778588A

United States Patent [19]

Allen, III et al.

[11] Patent Number: 5,778,588

[45] Date of Patent: Jul. 14, 1998

[54] FOLDING STOCK FOR A PISTOL

[76] Inventors: Charles Allen, III, 5329 Bayshore Blvd., Tampa, Fla. 33611; John R. Weaver, 3425 Yule Tree Dr., Edgewater, Fla. 32141; Shawn E. Webb, 342 Sunflower Trail, Orlando, Fla. 32828

[21] Appl. No.: 791,229

[22] Filed: Jan. 30, 1997

[51] Int. Cl.[6] ..... F41C 23/12; F41C 23/04

[52] U.S. Cl. ..... 42/71.02; 42/72

[58] Field of Search ..... 42/71.02, 72, 73, 42/71.01

[56] References Cited

U.S. PATENT DOCUMENTS

| | | | |
|---|---|---|---|
| 2,437,548 | 3/1948 | Patchett | 42/72 |
| 3,256,632 | 6/1966 | Beretta | 42/72 |
| 3,987,571 | 10/1976 | Orozco | 42/71.02 |
| 4,271,623 | 6/1981 | Beretta | 42/72 |
| 4,735,007 | 4/1988 | Gal | 42/72 |

FOREIGN PATENT DOCUMENTS

| | | | |
|---|---|---|---|
| 376520 | 5/1923 | Germany | 42/72 |
| 404036 | 5/1943 | Italy | 42/72 |
| 463353 | 4/1951 | Italy | 42/72 |
| 168890 | 6/1922 | United Kingdom | 42/72 |
| 561988 | 6/1944 | United Kingdom | 42/73 |
| 628732 | 9/1949 | United Kingdom | 42/72 |

*Primary Examiner*—Stephen M. Johnson
*Attorney, Agent, or Firm*—Tom Hamill, Jr.

[57] ABSTRACT

A folding stock is provided for a pistol. The stock is particularly suited for automatic pistols which may employ extended magazines. The stock includes a first end which mates with the hollow located in the rear portion of the grip of the pistol. A first stock element is attached to the first end. A second stock element is pivotally attached to the first stock element. The attachment includes a spring mounted push-button element. The push-button element, when depressed, permits rotation of the stock from a folded to an unfolded position and visa versa. The pivotal attachment is securable in a folded first position and an unfolded second position. The folded position brings the first stock element into a substantially parallel and proximal arrangement with the second stock element. The securing mechanism is engaged and disengaged by the push-button located on the right side of the intersection of the first stock element and the second stock element. The push-button may be a pin member which is urged into a secured position by a pair of resilient springs. The push-button, when depressed, pushes the springs into their nest. When the push-button is fully depressed, the first and second stock member may rotate between the folded position and the unfolded position. When the push-button is released, the spring force urges the pin member (push-button) back to the neutral position, thus securing the first and second stock member in a folded or unfolded relation. The second stock element includes an U-shaped bend about midway down its length which would permit simple loading of extended length clips when the stock is in its folded position. The second stock element is attached to a shoulder interface. When the stock is extended, the shoulder interface would rest against one's shoulder, when folded the shoulder interface rests against the trigger guard.

11 Claims, 4 Drawing Sheets

FOLDING STOCK FOR A PISTOL

BACKGROUND OF THE INVENTION

1. Field of the Invention

The present invention relates generally to folding stocks for pistols. More particularly, the present invention is drawn to a folding stock for a pistol especially adapted to be utilized by an automatic pistol which employs an extended magazine.

2. Description of the Prior Art

Modern pistols now commonly employ extended magazines which hold 17 or even 33 rounds. It is technically feasible to provide pistol magazines to hold even a greater number of rounds. Though utilization of such extended magazines the enthusiast may fire a greater number of bullets without reload. Pistol aim may be significantly improved by employing a stock which may rest against a shoulder. By using such a stock one may have greater control over the recoil one finds when firing the weapon on full-automatic or semi-automatic. Part of the enjoyment of such a pastime comes from the accurate delivery of a large number of shots to a given target in a short time period. Rapid reload is important to the enjoyment of the sport. A folding pistol stock which may be utilized with extended magazines in both the folded or unfolded position, and which may be folded while an extended magazine is being employed is desirable.

Folding stocks for pistols are known in the art. An example of such a device is U.S. Pat. No. 4,271,623 issued to Beretta. The Beretta device includes a stock which does fold, and includes means to secure the stock in an unfolded position. The means to secure the stock in an unfolded position includes a pair of spring biased actuating tabs, one on the right side of the stock and one on the left side of the stock. These actuating tabs must be simultaneously moved by the user toward the pistol to permit the folding stock to return to a folded position. This is difficult to accomplish, especially with one hand. The folding stock element is straight and does not permit the use of the pistol when in a folded position.

Thus, while the foregoing body of prior art indicates it to be well known to employ the use of a folding stock with an automatic pistol, the use of a folding stock which does not interfere with the firing of the pistol when in a folded position has not been contemplated. The provision of a folding pistol stock which permits the use of extended magazine elements has not been taught as well. The prior are does not teach a device which may fire the pistol while in either the folded or unfolded state. The foregoing disadvantages are overcome by the unique structural features of the present invention as will be made apparent from the following description thereof. Other advantages of the folding stock of the present invention over the prior art also will be rendered evident.

SUMMARY OF THE INVENTION

To achieve the foregoing and other advantages, the present invention, briefly described, provides a folding stock for a pistol. The invention is particularly suited for automatic pistols which may employ extended length magazines. The stock includes a first end which mates with the hollow located in the rear portion of the pistol grip. A first stock element is attached to the first end. A second stock element is pivotally attached to the first stock element. The first stock element may rotate with respect to the second stock element.

The attachment includes a spring mounted push-button element. The push-button element, when depressed, permits rotation of the stock from a folded to an unfolded position and visa versa. The folded position brings the first stock element into a substantially parallel and proximal arrangement with the second stock element. The pivotal attachment is securable in a folded first position and an unfolded second position. The securing mechanism is engaged and disengaged by the push-button located on the right side of the intersection of the first stock element to the second stock element. The push-button is essentially a pin member which is urged into a secured position by a pair of resilient springs. The push-button, when depressed, pushes the springs into their nest. When the push-button is fully depressed, the first and second stock member may rotate between the folded position and the unfolded position. When the push-button is released, the spring force urges the pin member (push-button) back to the neutral position, thus securing the first and second stock member in a folded or unfolded relation. The second stock element includes an U-shaped bend about midway down its length which would permit simple loading of extended length clips when the stock is in its folded position. The second stock element is attached to a shoulder interface. When the stock is extended, the shoulder interface would rest against one's shoulder, when folded the shoulder interface rests against the trigger guard. The preferred embodiment is drawn to a folding stock which may be utilized with a Glock-17 or Glock-18 pistol. It is to be understood that the instant invention may be employed with many other varieties of automatic pistols. The instant device may be employed in both the folded and unfolded configuration to fire the pistol. The pistol may be loaded and unloaded while the stock is folded or unfolded and may be unfolded or folded with a magazine in the chamber, regardless of the size of the magazine.

It is proposed that the folding gun stock be manufactured from any of a variety of materials which possess the appropriate mechanical properties of strength and resistance to failure by fatigue. Such materials include metals such as aluminum or steel compositions, or composite materials such as graphite. Any material with the desired properties may be employed. The folding gun stock may be machined, stamped or manufactured by any of a variety of well known manufacturing processess.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will form the subject matter of the claims appended hereto.

In this respect, before explaining the invention in detail, it is to be understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which this disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

It is therefore an object of the present invention to provide a folding pistol stock which may be easily placed in a folded or unfolded position by actuation of a push-button.

It is an object of the present invention to provide a folding pistol stock which may be locked in a folded or unfolded position.

It is an object of the present invention to provide a folding pistol stock which would permit firing of the pistol when in the folded position.

It is an object of the present invention to provide a folding pistol stock which may be folded while the pistol has an extended magazine placed therein.

It is an object of the present invention to provide a folding pistol stock which, when affixed to the pistol and in the folded configuration, may discharge and receive a magazine of any size.

It is another object of the present invention to provide a folding pistol stock which may be easily and efficiently manufactured and marketed.

It is a further objective of the present invention to provide a folding pistol stock which is of durable and reliable construction.

An even further object of the present invention is to provide a folding pistol stock which is susceptible of a low cost of manufacture with regard to both materials and labor, and which accordingly is then susceptible of low prices of sale to the consuming public, thereby making such a folding pistol stock available to the buying public.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawings wherein:

FIG. 3A is a view taken along line 3A—3A of FIG. 2 describing the interface of the shoulder rest and the trigger guard when the folding stock is in the folded position.

DESCRIPTION OF THE PREFERRED EMBODIMENT

With reference now to the drawings, a folding pistol stock embodying the principles and concepts of the present invention will be described.

Figure 1:
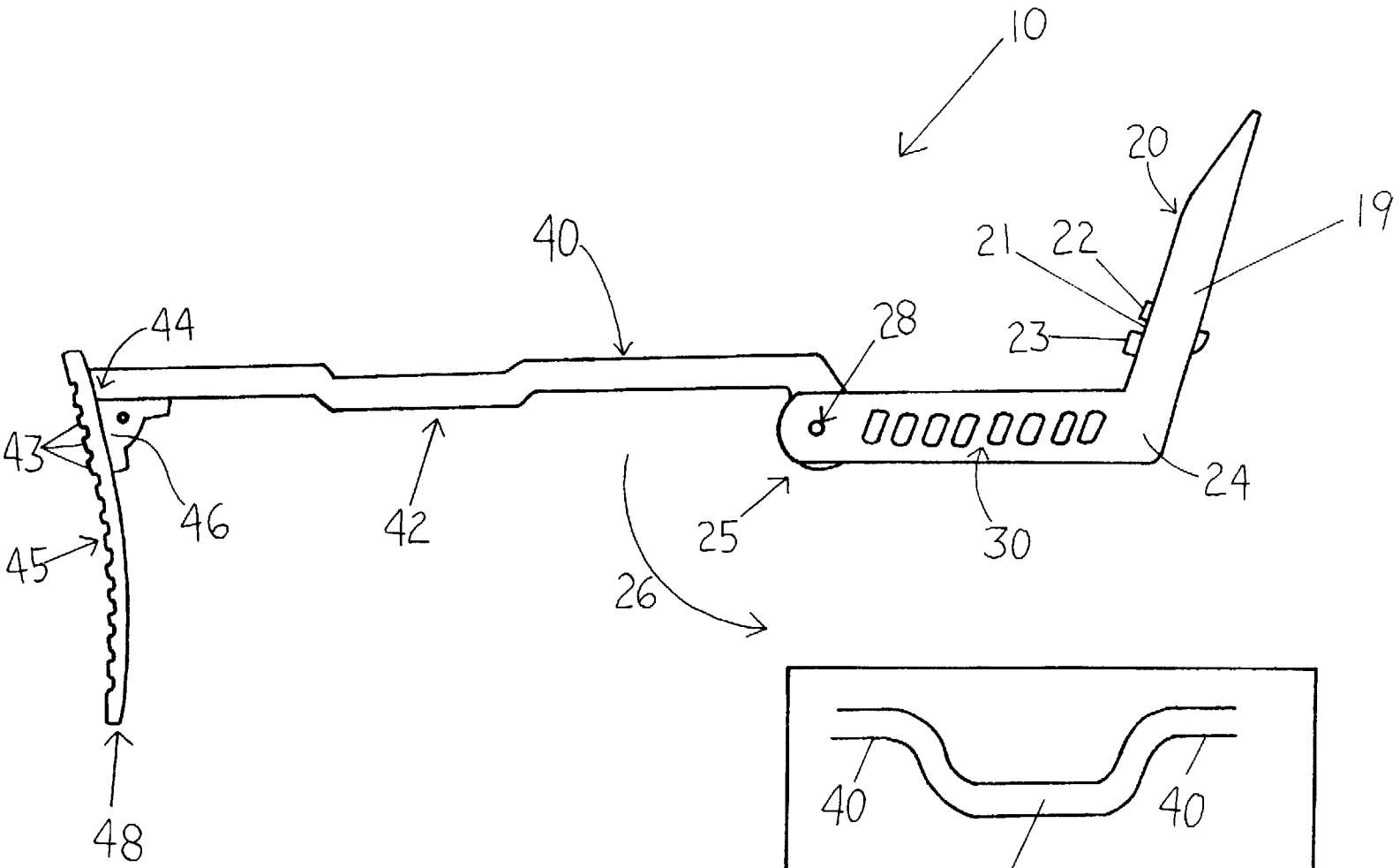
FIG. 1 is a perspective view showing the folding stock for a pistol in the unfolded (extended) position sans pistol.
Figure 2:
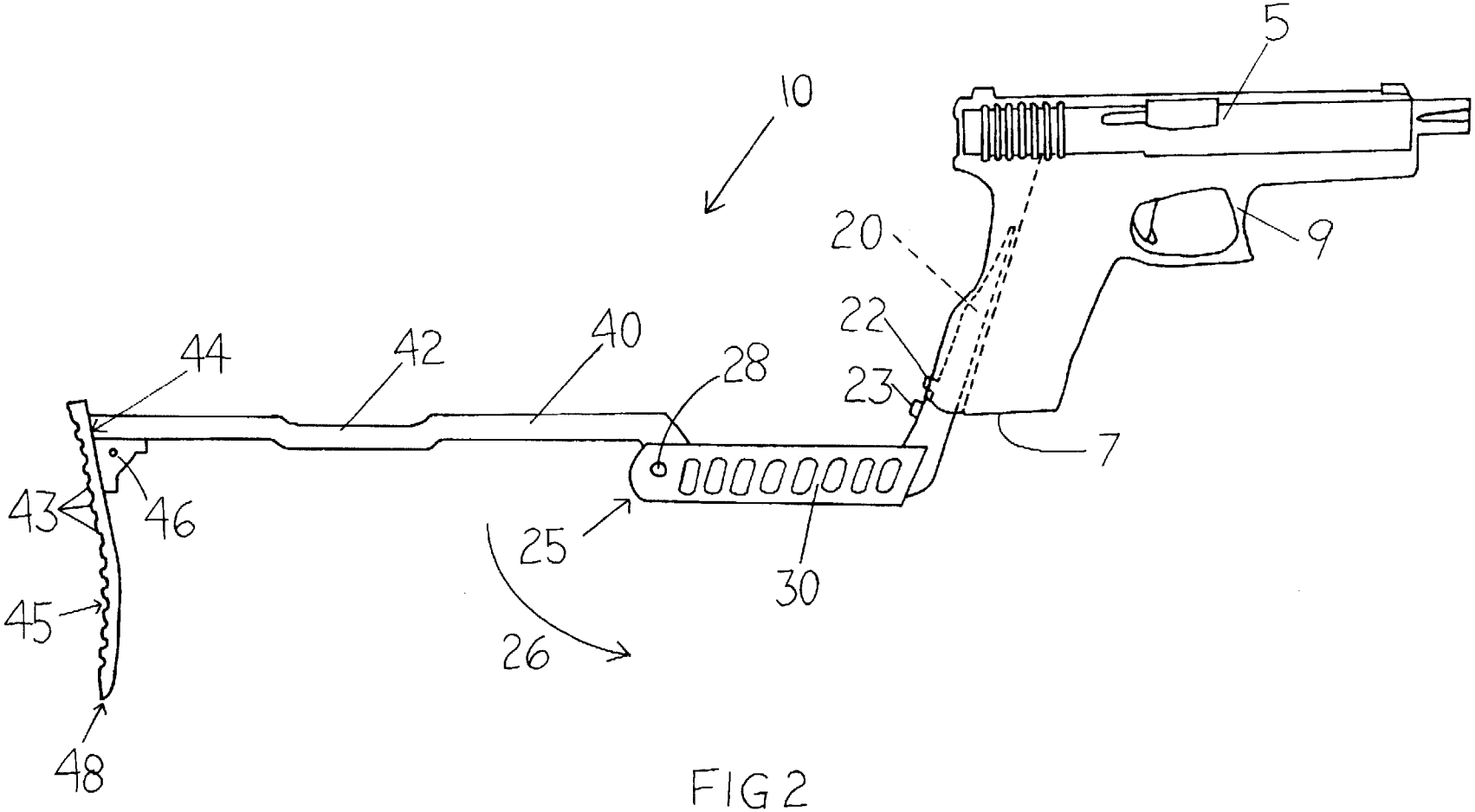
FIG. 2 is a perspective view showing the folding stock for a pistol in the unfolded (extended) position with pistol affixed.

Turning initially to FIGS. 1 & 2, the folding pistol stock 10 is shown. A first end 20 is shown which is inserted in a hollow located proximal the rear portion of the pistol grip 8. Locking means 19 includes a spring biased plate 21 with several pin portions (22, 23). The pin portion 22 will engage mating structure located on the pistol. The locking means 19 will securely affix the folding stock 10 to the pistol in such a fashion to prevent the pistol from accidental detachment, while insuring simplicity of intentional removal. When mated, the pin portion 23 resides outside the hollow of the pistol grip. When pin portion 23 is depressed, the spring biased plate is pushed inwardly, releasing pin portion 22 from the mating structure located on the pistol, permitting removal of the first end 20. Other specific means of attachment may be employed to permit the instant invention to be utilized with pistols with different pistol grip and folding stock configurations.

The first end 20 is connected to a first stock element 30 proximal element 24. First stock element 30 is a generally elongated rod like structure which may have a circular, rectangular, square or other geometric cross-section. Portions of the first stock element 30 may be hollowed out for weight reduction. A second stock element 40 is pivotably attached to first stock element 30 at pivotal attachment 25. Second stock element 40 is a generally elongated rod like structure which may have a circular, rectangular, square or other geometric cross-section.

The pivotal attachment 25 permits the second stock element 40 to rotate with respect to the first stock element 30 as indicated by arrow 26. Push-button 28 is mated with a stock locking means. The stock locking means secures the stock in the folded as well as unfolded position. When the stock is in the unfolded position, it is securely locked in that position by the stock locking means. When the stock is in the folded position it is securely locked in that position by the stock locking means. The stock locking means is disengaged during the rotation of the first stock element 30 with respect to the second stock element 40. The stock locking means may be disengaged through the depression of the push-button 28. When the push-button 28 is depressed the second stock element 40 is free to rotate with respect to the first stock element 30. Specific details of the stock locking means will be detailed in the discussion of FIGS. 4, 4A, & 4B.

The second stock element 40 includes a U-shaped portion 42. The utility of the U-shaped portion 42 will best be seen in subsequent figures showing the stock in the folded configuration. The U-shaped portion 42 will permit the second stock element 40 to be placed in the folded configuration when the pistol has an extended length magazine located therein. Once the stock is placed in the folded position, the U-shaped portion 42 permits a magazine to be changed, as well as permits the use of extended length magazines.

Second stock element 40 is attached to shoulder rest 45 proximal element 44. Brace 46 is affixed to both shoulder rest 45 and second stock element 40 and prevents failure of the attachment at element 44 due to the stresses of firing and general use. The brace 46 is secured to the shoulder rest 45 and the second stock element 40 by any of a variety of well known attachment means including, but not limited to, mechanical fasteners, welding or adhesives. The shoulder rest 45 includes a plurality of ridges 43 which create a non-smooth surface for retaining the shoulder rest 45 in position against the users shoulder. At the distal end of the shoulder rest 45 is a generally U-shaped element 48 which is shown in FIG. 3A. The U-shaped portion 48 will engage the trigger guard 9 of the pistol 5 when the stock 10 is in a folded configuration.

Figure 1A:
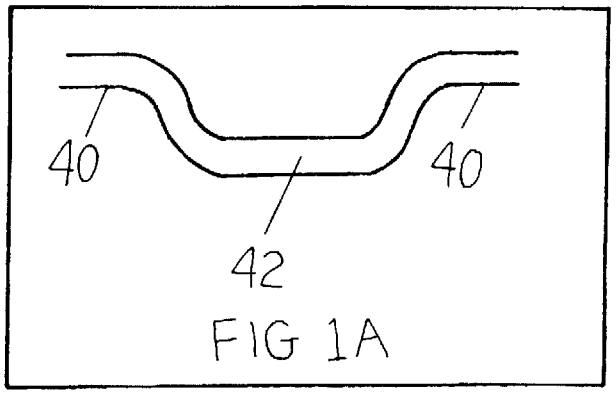
FIG. 1A is a cut-away top view showing the U-shaped portion of the second stock element.

FIG. 1A shows the U-shaped portion 42 located on the second stock element 40. The U-shaped element 42 will permit use of the stock while in the folded state. The U-shaped element 42 allows magazines of any size to be changed while the folding stock is folded.

FIG. 2 shows the folding stock 10 of the present invention in the unfolded position with a pistol 5 attached thereto. The pistol 5 may be an automatic pistol manufactured by Glock. The Glock pistol has appropriate mating surfaces located in the rear portion of the pistol grip 8 for use with the folding stock 10. The folding stock 10 may include modifications to permit its use with other pistols. Appropriate mating surfaces may be simply machined into existing pistols to permit their use with the folding stock 10. The pistol 5 has a trigger guard 9 which will interface with U-shaped portion 48 of the shoulder rest 45.

Figure 3:
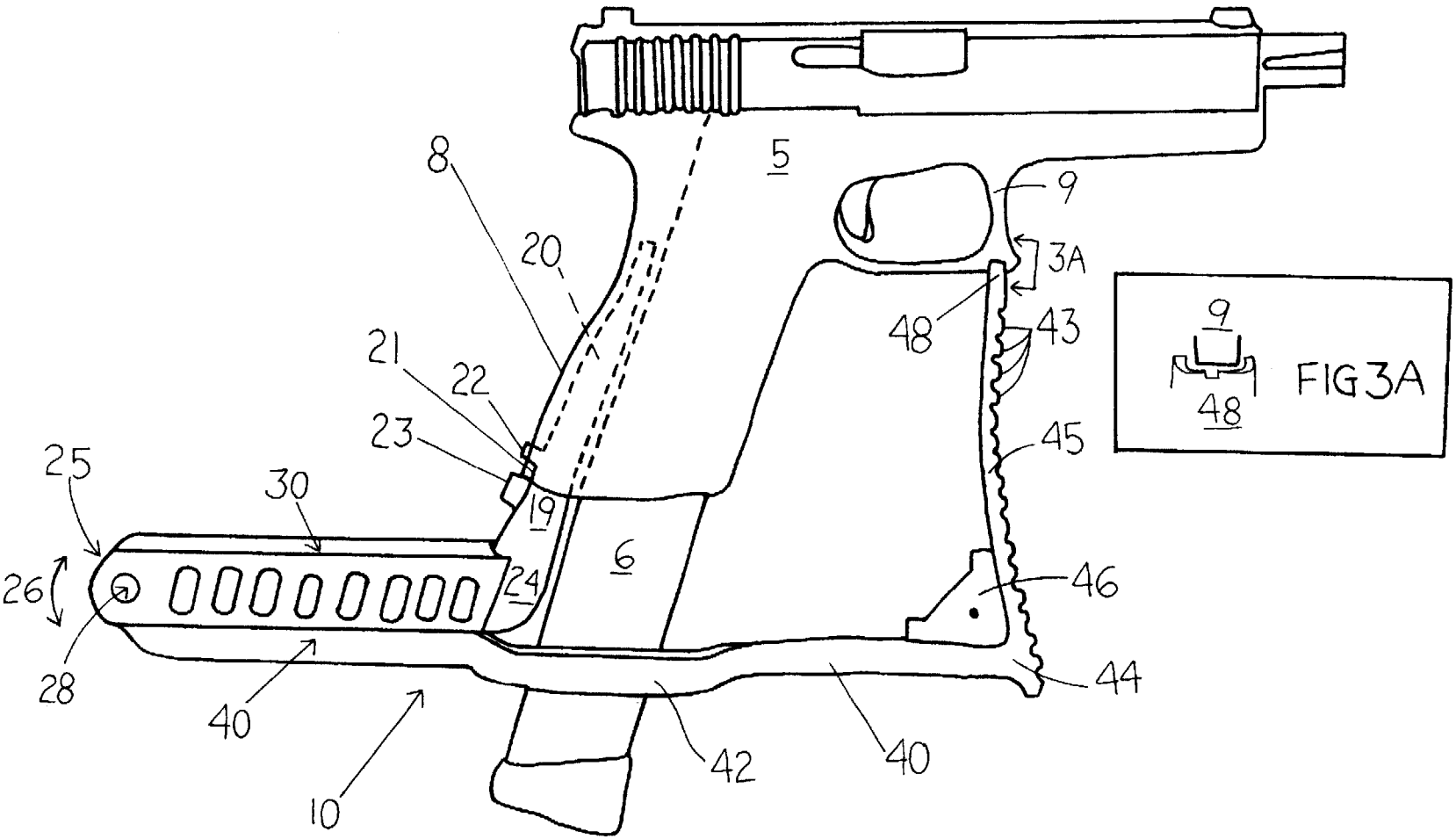
FIG. 3 is a perspective view showing the folding stock for a pistol in the folded position with the pistol attached thereto, the pistol further having an extended magazine in the magazine well.

FIG. 3 shows the folding stock 10 in the folded position with a pistol 5 attached. An extended magazine 6 is shown fully inserted into the magazine well. The first end 20 is shown inserted into the hollow located in the hollow located near the rear portion of the pistol grip 8. Locking means 19 includes a first pin portion 22 and a second pin portion 23. Both the first pin portion 22 and the second pin portion 23 reside atop a spring biased plate 21. The first pin portion 22 will mate with structure located on the rear of the pistol grip 8. This structure includes an aperture which is found on certain brands of pistols, including the Glock pistols. The locking means 19 will securely affix the folding stock 10 to the pistol 5 in such a fashion as to prevent accidental detachment. When the first end 20 is inserted into the hollow, the second pin portion 23 resides outside the hollow of the pistol grip. When the second pin portion 23 is depressed, the spring biased plate 21 is urged inwardly, releasing pin portion 22 from the mating structure located on the pistol 5, permitting removal of the first end 20. As noted previously, other arrangements of the attachment means may be provided to permit the instant invention to mate with different pistols.

The first end 20 is connected to the first stock element 30 proximal element 24. The first stock element 30 may be affixed to the first end 20 by any variety of mechanical fasteners, welding, or adhesive. The first stock element 30 is pivotably attached to the second stock element 40 at pivotable attachment 25. The second stock element 40 is shown as being rotated and secured under the first stock element 30.

The pivotal attachment 25 permits the second stock element 40 to rotate with respect to the first stock element 30 and visa versa as indicated by arrow 26. Push-button 28, when actuated, disengages a stock locking means which permits the rotation of the first and second stock element as indicated by arrow 26. The folded position brings the first stock element 30 into a substantially parallel and proximal arrangement with the second stock element 40. Specific details of the stock locking means will be described in the discussion of FIG. 4, 4A, & 4B.

The second stock element 40 includes a U-shaped portion 42. As shown in FIG. 3, the U-shaped portion 42 permits the use of the folding stock 10 with the extended magazine 6. The U-shaped portion 42 will permit magazines of any size to be placed within and removed from the magazine well, while the folding stock 10 is in the folded position. The U-shaped portion 42 is proportioned and toleranced in such a manner to permit the folding stock 10 to be unfolded and folded with an extended magazine 6 residing within the pistol 5.

The second stock element 40 is attached to the shoulder rest 45 proximal 44. Brace 46 is affixed both to the shoulder rest 45 and the second stock element 40. The brace 46 prevents failure of the attachment of the shoulder rest 45 to the second stock element 40 which may occur to the stresses placed thereon by firing the pistol and through rough usage of the shoulder rest 45. The shoulder rest 45 includes a plurality of ridges 43 which create a non-smooth surface for retaining the shoulder rest 45 in position against the shoulder of the marksman. U-shaped portion 48 will engage the trigger guard 9 of the pistol 5 when the folding stock 10 is in the folded configuration.

FIG. 3A is a view taken along line 3A—3A of FIG. 3. It is a close up clearly showing the U-shaped portion 48 engaging the trigger guard 9.

Figure 4B:
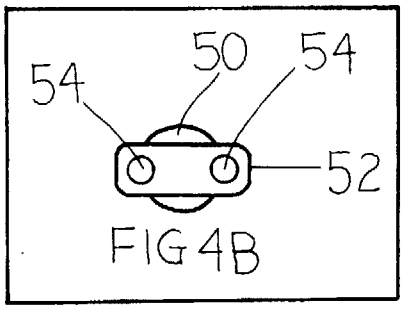
FIG. 4B is a view of the push-button showing details of the rotating locking element.
Figure 4A:
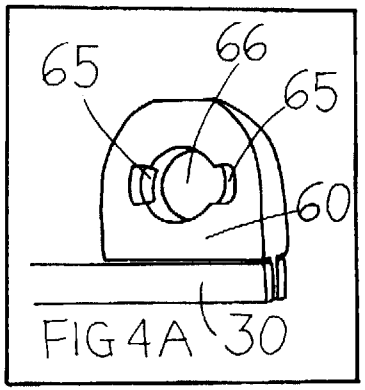
FIG. 4A is a view of the tongue which rotates when the push-button is employed.
Figure 4:
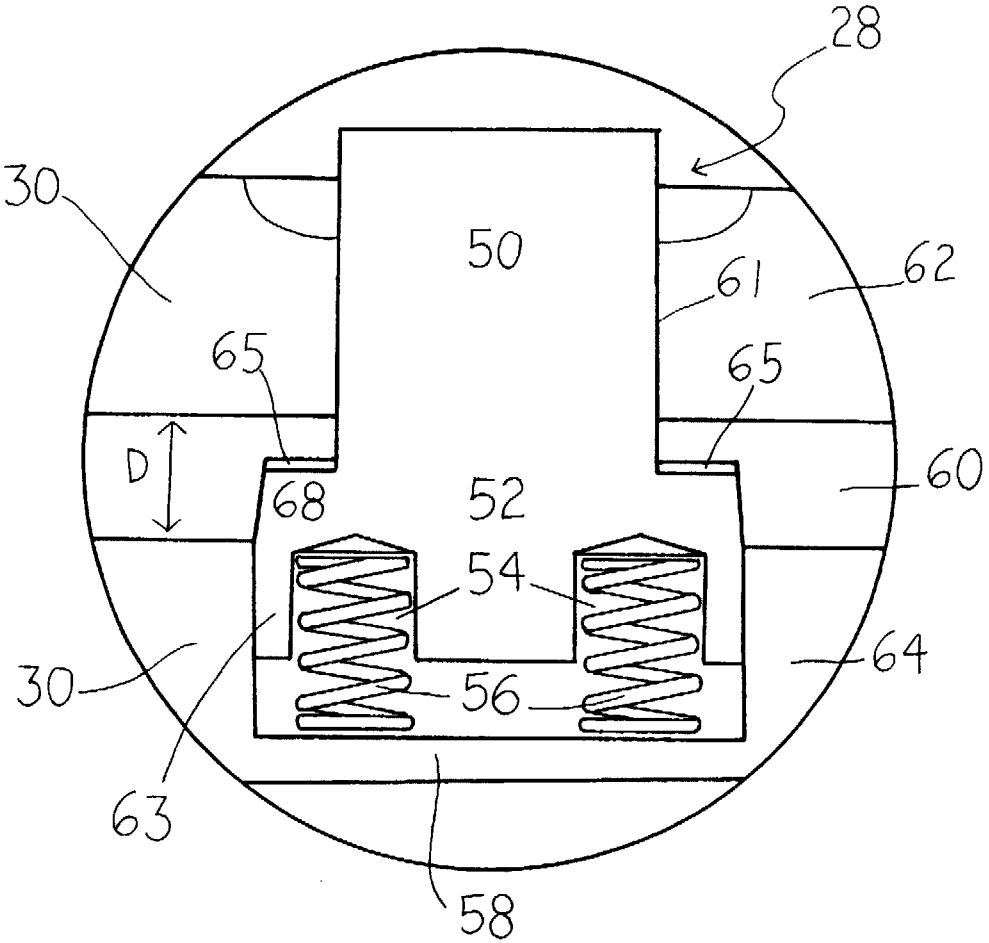
FIG. 4 is a cut away view of the spring biased push-button mechanism.

FIG. 4 is a cut away view detailing the push-button 28 and associated stock locking means. The push-button 28 has a generally upper cylindrical portion 50 integrally connected with a lower rectangular portion 52. The lower rectangular portion 52 has a pair of apertures 54 designed to receive a pair of springs 56. The springs 56 rest intermediate the back plate 58 which is a portion of the first stock element 30. Tongue 60 is attached to the second stock element 40 and resides in a cut-away portion of the first stock element 30 intermediate first side 62 and second side 64. Tongue 60 includes a rectangular cut-away portion 65 which is toleranced to receive the lower rectangular portion 52 snugly. When push-button 28 is depressed, the lower rectangular portion 52 is urged out of the rectangular cut-away portion 65. At this point, tongue 60 may be rotated about 180 degrees, to a point where the rectangular cut-away portion 65 and the lower rectangular portion 52 once again align. At this point, the spring force generated by the springs 56, urges the lower rectangular portion 52 into the rectangular cut-away portion 65. This secures the first stock element 30 with respect to the second stock element 40 in a folded or unfolded relation. A stop may be provided to prevent rotation in the undesired direction. It is important to note that the first side 62 of first stock element 30 has a toleranced cylindrical opening 61, whereas the second side 64 of the first stock element 30 has a toleranced cylindrical opening superposed over a toleranced rectangular opening 63.

FIG. 4A shows the tongue 60 attached to first stock element 30. The rectangular cut-away portion 65 is centrally disposed on the tongue 60. Central aperture 66 passes through the tongue 60 completely. The rectangular cut-away portion 65 is cut-away to a point about half the depth of the total depth (indicated by D in FIG. 4) of the tongue 60.

FIG. 4B shows the push-button 28 showing the lower rectangular portion 52 with the pair of apertures 54. The upper cylindrical portion 50 is also shown in relation to the lower rectangular portion 52.

It is apparent from the above that the present invention accomplishes all of the objectives set forth by providing a new and improved folding stock for pistols, which may be simply and easily placed from a folded to an unfolded position, and permits firing of the pistol when in the folded position.

With respect to the above description, it should be realized that the optimum dimensional relationships for the parts of the invention, to include variations in size, materials, shape, form, function and manner of operation, assembly and use, are deemed readily apparent and obvious to those skilled in the art, and therefore, all relationships equivalent to those illustrated in the drawings and described in the specification are intended to be encompassed only by the scope of appended claims.

While the present invention has been shown in the drawings and fully described above with particularity and detail in connection with what is presently deemed to be the most practical and preferred embodiment of the invention, it will be apparent to those of ordinary skill in the art that many modifications thereof may be made without departing from the principles and concepts set forth herein. Hence, the proper scope of the present invention should be determined only by the broadest interpretation of the appended claims so as to encompass all such modifications and equivalents.

What is claimed as being new and desired to be protected by Letters Patent of the U.S. is as follows:

1. A folding stock for use with a pistol which employs a magazine comprising:

a pistol mating element, said pistol mating element attached to a first stock element, said first stock element rotatably attached to a second stock element, said second stock element attached to a shoulder rest, said second stock element further having a U-shaped portion thereon, said U-shaped portion forming an open area which would receive the magazine therethrough whereby said U-shaped portion permits the magazine to be placed into, be removed from, or remain within the pistol when said stock is folded, as well as permits said stock to be folded without coming in contact with the magazine.

2. A folding stock for use with a pistol as claimed in claim 1 wherein said pistol mating element includes a tongue portion, said tongue portion is received in the rear of the pistol grip, said pistol mating element further including securing means to secure said tongue portion in the rear of the pistol grip.

3. A folding stock for use with a pistol as claimed in claim 1 wherein said first stock element and said second stock element includes securing means for securing said first stock element in a first position with respect to said second stock element.

4. A folding stock for use with a pistol as claimed in claim 3 wherein said securing means includes means for securing said first stock element in a second position with respect to said second stock element.

5. A folding stock for use with a pistol as claimed in claim 4 wherein said stock may be folded from said first position to said second position by use of a push-button means, whereby actuation of said push-button means disengages said securing means.

6. A folding stock for use with a pistol as claimed in claim 5 wherein said shoulder rest includes an upper portion and a lower portion, said upper portion being attached to said second stock element, said lower portion having a bottom element, said bottom element including a U-shaped cut-out.

7. A folding stock for use with a pistol as claimed in claim 6 wherein said U-shaped cutout will rest on the trigger guard of the pistol when said stock is in said second position.

8. A folding stock for use with a pistol comprising an elongated, foldable extension intermediate a pistol mating means and a shoulder rest, said foldable extension including a first portion and a second portion, said first portion connected to said pistol mating means, and said second portion connected to said shoulder rest, said first portion in a foldable relation to said second portion, said foldable extension having an unfolded position and a folded position, said folded position bringing said second portion in a position beneath and substantially parallel to said first portion, said unfolded position being generally extended 180 degrees from the folded position, said second portion further having a U-shaped element thereon, whereby said foldable extension may accommodate the magazine when in said folded position.

9. A folding stock for use with a pistol as claimed in claim 9 wherein said foldable extension includes locking means for locking said foldable extension in said folded position and in said unfolded position.

10. A folding stock for use with a pistol as claimed in claim 10 wherein said locking means includes a push-button, said push-button, when depressed, releases said locking means, permitting said foldable extension to be folded from said folded position to said unfolded position and visa versa.

11. A folding stock for use with a pistol as claimed in claim 11 wherein said pistol mating means includes a second locking means, said second locking means securing said folding stock to said pistol, said second locking means including a release means which, when actuated, permits said pistol mating means to be withdrawn from the pistol.

* * * * *